United States Patent [19]

Shamlian et al.

[11] 3,933,049

[45] Jan. 20, 1976

[54] DECOMPRESSION INDICATING INSTRUMENT FOR DIVERS

[75] Inventors: Ralph B. Shamlian, San Francisco; Ashley J. Hollingsworth, Atherton, both of Calif.

[73] Assignee: Farallon Industries, Inc., Belmont, Calif.

[22] Filed: July 3, 1974

[21] Appl. No.: 485,455

[52] U.S. Cl. ..... 73/432 R

[51] Int. Cl.[2] ..... G01F 23/14

[58] Field of Search..... 73/432 R, 291, 299, 300, 73/389

[56] References Cited

UNITED STATES PATENTS

| | | | |
|---|---|---|---|
| 3,377,860 | 4/1968 | Masters | 73/291 |
| 3,457,393 | 7/1969 | Stubbs et al. | 73/432 R UX |
| 3,463,015 | 8/1969 | Gulino et al. | 73/432 R |
| 3,681,585 | 8/1972 | Todd | 73/432 R UX |
| 3,696,610 | 10/1972 | Charbonnier | 73/291 X |
| 3,710,625 | 1/1973 | Borom et al. | 73/432 R |
| 3,757,586 | 9/1973 | Borom | 73/432 R |
| 3,759,101 | 9/1973 | Borom et al. | 73/291 |
| 3,759,109 | 9/1973 | Borom et al. | 73/432 R |
| 3,777,573 | 12/1973 | Alinari | 73/432 R |
| 3,822,601 | 7/1974 | Borom | 73/432 R |

*Primary Examiner*—Richard C. Queisser
*Assistant Examiner*—Joseph W. Roskos
*Attorney, Agent, or Firm*—Lowhurst, Aine & Nolan

[57] ABSTRACT

A decompression analog computer and indicator includes an ambient pressure sensing chamber exposed to hydrostatic pressure as experienced by the diver. The pressure in sensing chamber produces a flow of fluid between the sensing chamber and a pair of parallel connected second chambers via the intermediary of first and second diffusion membranes introducing a delay to simulate different tissues of the body. Each of the second chambers has a movable wall portion operatively connected to a spring biased pressure responsive indicating piston. The indicating pistons move to and fro in a track overlying at indicating scale visible to the diver. The indicators indicate uptake and release of nitrogen by different tissues within the body and indicate to the diver when decompression is necessary.

17 Claims, 4 Drawing Figures

DECOMPRESSION INDICATING INSTRUMENT FOR DIVERS

BACKGROUND OF THE INVENTION

The present invention relates in general to decompression indicating instruments for divers and more particularly to such instruments employing an analog decompression computer and indicating means and having the capability of computing the effect of repeat dives.

DESCRIPTION OF THE PRIOR ART

Heretofore, pneumatic analog decompression instruments have been proposed for use in calculating and indicating decompression schedules. These devices have utilized a semipermeable membrane through which a gas was caused to diffuse, in response to hyperbaric exposure of underwater excursions, into a time-constant chamber in simulation of the uptake and release of nitrogen by a diver's body tissue. A plurality of such time-constant chambers and different semipermeable membrane structures have been provided for simulating the various different body tissues of the diver.

Pressure measuring means have been used for measuring the pressure of gas in the time-constant chamber and springs have been employed for spring biasing the pressure measuring means to allow for the ability of the human body tissue to withstand an internal over-pressure without nucleating gas bubbles, i.e., causing the bends.

Examples of such prior art decompression computers and instruments are found in U.S. Pat. Nos. 3,759,108 issued 18, Sept. 1973; U.S. Pat. No. 3,757,586 issued Sept. 11, 1973 and U.S. Pat. No. 3,759,101 issued Sept. 18, 1973.

In these prior art decompression computers, the delay time constant for the simulation of uptake of gas by the various tissues was approximately equal to the delay time constant for simulation of outgassing of gas from the tissues. In a repeat dive situation, the diver, after accumulating a certain amount of gas in his tissues, generally ascends to the surface in preparation for his next dive. Because the pressure differential is generally lower between the pressure in the time-constant chamber and the ambient pressure at the surface than was experienced during the dive, the outgassing of the time-constant chamber normally takes considerably longer than the dive time.

Accordingly, scales have been provided on the indicator dial face, of prior art devices, to partially take into account the residual gas within the tissue of the diver such scale having letter indicia corresponding to the various letters in the Navy repeat dive table. The idea is that the diver could read off the indicated letter scale indicia of his decompression meter and use the letter indicia for entry into the Navy repeat dive tables to permit a calculation of the time and depth of his next dive so as to be able to determine whether decompression would be required and if so the appropriate schedule.

The meter reading could not be used directly, i.e., without reference to the Navy repeat dive tables and computations based thereon, because the repeat dive tables are based upon a tissue outgassing half time of 120 minutes or in excess thereof, whereas the Navy tables are based upon tissue uptake half times of 20, 40, 80 and 120 minutes and tissue ratios of 2.5/1 to 1.8/1.

The tissue ratio relates to the fact that human tissue can withstand, to varying degrees, an internal over pressure, i.e., super saturation during decompression without nucleating gas bubbles. This is referred to as a tissue ratio and is given by the expression:

Tissue Ratio = Safe Maximum Tissue Pressure/Ambient Pressure with the pressure given on an absolute scale.

Thus, the prior art decompression computers have used a plurality of different delay times for delaying the diffusion of gas from the ambient chamber into the time-constant chambers. These delay times have been arranged to approximate the 20, 40, 80 and 120 minute half times of the body tissues in accordance with the standard Navy decompression tables.

However, the standard Navy repeat dive decompression tables are based upon outgassing half time tissues having half times of 120 minutes or in excess thereof. Thus, the prior art decompression meters which have been based upon tissue half times which were equal for the uptake as well as the outgassing of the tissue had insufficient outgassing memory to yield readouts on repetitive dives that would correspond with the Navy decompression repeat dive tables. Accordingly, for repeat dives, the diver was required to utilize the Navy tables making a number of calculations therefrom rather than being able to rely upon meter readings of his decompression instrument.

Others have proposed use of a virus filter material in lieu of the semipermeable membrane material for providing a resistance to flow of air between the ambient pressure sensing chamber and the respective time constant chamber. In such an arrangement the different tissue half times have been simulated by connecting a number of such resistors and time constant chambers either in parallel with each other or in series with each other. Such a decompression computer is disclosed in U.S. Pat. No. 3,457,393 issued July 22, 1969.

The virus filters are formed of a microscopic mesh of synthetic plastic fibers having a mean pore diameter of the order of five times $10^{-6}$ centimeters ($0.05\mu$) and that they were characterized by three different types of fluid flow therethrough. In one regime they provide free molecular flow, in another regime they provide viscous flow and still another regime they exhibited slip flow. Slip flow is nonlinear with pressure differential across the medium and is believed that it is in this region of their flow characteristic that the porous medium filter was found to operate in the decompression computer application.

When a virus filter of the above type is employed as the pneumatic resistor in the flow passageway between the ambient sensing chamber and a respective time constant chamber the filter material provides a longer tissue half time constant for the flow of fluid from the time constant chamber back to the ambient sensing chamber than for the flow from the ambient sensing chamber to the time constant chamber. As it turns out this is a fortuitous flow condition since it was found, particularly in the series connected version utilizing four series connected tissue half time time constant chambers that the outgassing simulation of such a computer closely simulated the outgassing characteristics of human tissue in response to hyperbaric exposure of underwater excursions. As a result, the series computer utilizing the porous virus filter medium as the pneumatic resistor could be utilized for automatically computing the decompression for random profile dives and repetitive exposures. Such a decompression computer is described in a book titled "Physiology and Medicine of Diving and Compressed Air Work" edited by P.B. Bennett and D.H. Elliott published in 1969 by Bailliere, Tindall & Cassell in London, see Chapter 16, pages 386–413.

Moreover, the prior art instruments employed a Bourdon gauge mechanism for reading out the pressure in the time-constant chamber. Generally speaking, a Bourdon type pressure gauge mechanism requires a substantial amount of mechanical amplification or multiplication between the movement of the Bourdon tube and the indicator needle. This mechanical multiplication results in making the Bourdon gauge relatively sensitive to shock and vibration and therefore the instruments were relatively fragile. It would be desirable to have a more rugged and reliable pressure indicating means for indicating the pressure in the time-constant chamber.

SUMMARY OF THE INVENTION

The principal object of the present invention is the provision of an improved decompression indicating instrument for divers.

In one feature of the present invention, the decompression indicating instrument includes an analog decompression computer employing one or more delays corresponding to one or more tissue half times for simulating the uptake of gas by the tissues of the body and employing a substantially longer tissue half time delay for computing the outgassing of gas from the tissues, whereby the decompression instrument may be employed for indicating decompression requirements for repetitive dives without resort to the Navy decompression repetitive dive tables and computations based thereon.

In another feature of the present invention, the decompression analog computer includes an indicating member operatively connected to a movable wall of the time-constant chamber, such indicating member moving to and fro for directly indicating the necessity, if any, for decompression of the diver, whereby a more rugged and more reliable indicating means is obtained.

Other features and advantages of the invention will become apparent upon a perusal of the following specification taken in connection with the accompanying drawings wherein:

DESCRIPTION OF THE PREFERRED EMBODIMENTS

Figure 1:
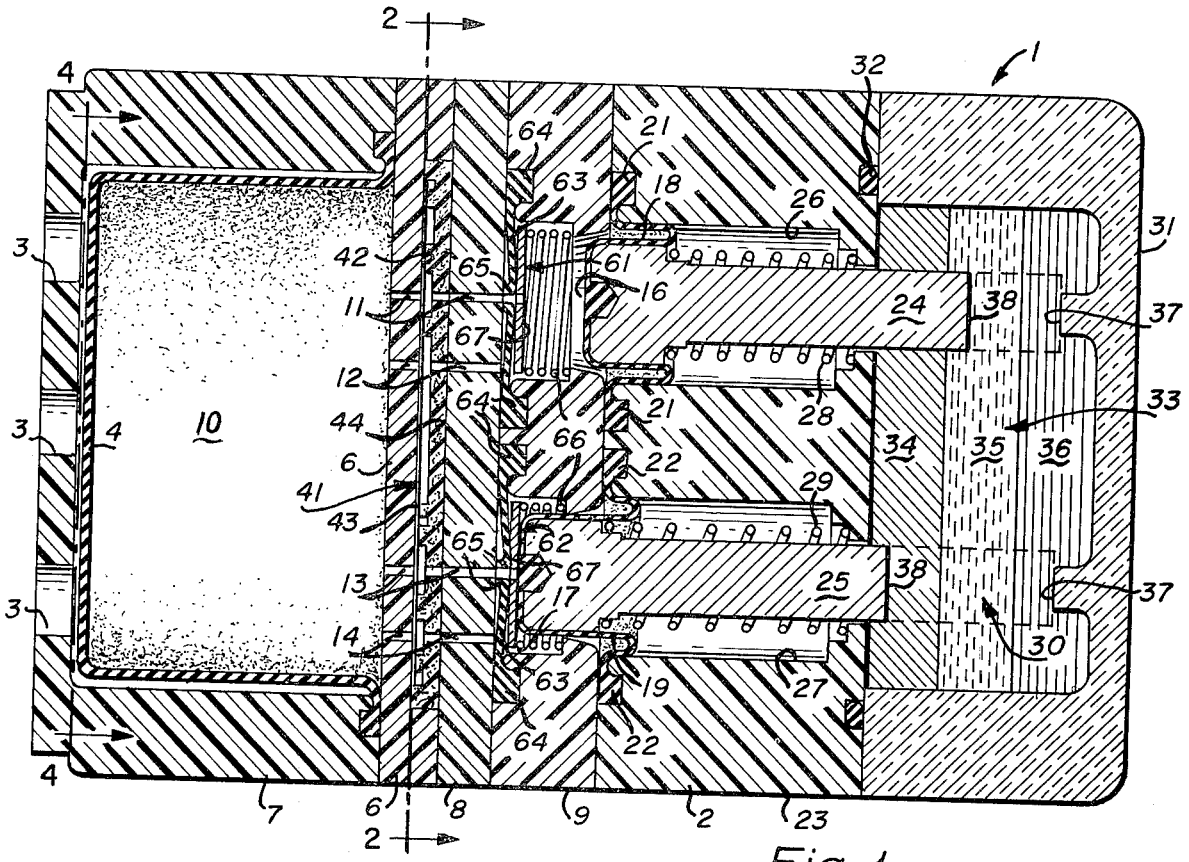
FIG. 1 is a longitudinal sectional view of a decompression computer incorporating features of the present invention.
Figure 4:
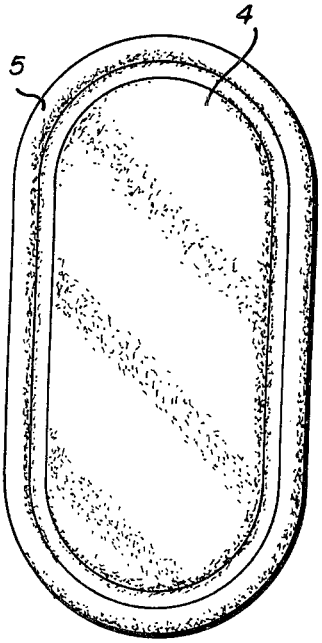
FIG. 4 is an end view of a portion of the structure of FIG. 1 taken along line 4—4 in the direction of the arrows.

Referring now to FIG. 1, there is shown a decompression computer 1 incorporating features of the present invention. The computer includes a submersible housing 2, as a Lexan plastic material. The housing 2 is perforated with perforations 3 at one end thereof to allow fluid communication with an ambient pressure sensing chamber 10 defined by a generally cupped shaped bladder 4 as of neoprene rubber (see FIG. 4). The cup shaped bladder 4 is sealed at its lip 5 to an end closing membrane plate 6, as of Lexan plastic. The housing 2 includes a bladder cap portion 7 which is held against the membrane plate 6 by means of four bolts, not shown, passing longitudinally of the housing 2 at the four corners of the housing 2 when considered in transverse section.

A generally rectangular valve plate 8 is captured between the membrane plate 6 and a valve block 9. The membrane plate 6 and valve plate 8 each includes four axially directed and aligned bores 11, 12, 13 and 14, respectively, communicating between the ambient pressure sensing chamber and a pair of time-constant chambers 16 and 17 formed in the valve block 9.

The outer ends of the time-constant chambers 16 and 17 are closed off via deformable diaphragms 18 and 19, respectively, as of neoprene rubber. The diaphragms are generally circular and sealed at their periphery to the valve block 9 at 21, and 22, respectively by being captured in compression between the valve block 9 and a cylinder block 23.

Diaphragms 18 and 19 are fixedly secured to the inner ends of elongated indicator pistons 24 and 25, respectively. The indicator pistons are coaxially disposed of cylindrical longitudinal extending bores 26 and 27 in the cylinder block 23. Compression springs 28 and 29, respectively, are disposed in the bores 26 and 27 for spring biasing the respective indicating pistons 24 and 25 inwardly of the time-constant chambers 16 and 17, respectively. A clear plastic viewing cap 31, as of clear Lexan, is hermetically sealed over the end of the cylinder block 23 via an O-ring seal 32.

A dial label 33 is affixed within the viewing cap 31 on the bottom side thereof with three transverse longitudinally spaced different colored zones defining indicia thereon. In a typical example, the first zone 34 is green, the second zone 35 is yellow and the third zone 36 is red. The indicating plungers 24 and 25 move to and fro in longitudinally directed tracks overriding the indicating zones 34, 35 and 36. Stop bosses 37 project inwardly from the end wall of the viewing cap 31 in axial alignment with the respective indicating plungers 24 and 25 for limiting the maximum outer axial translation of the plungers 24 and 25 at the innermost extent of travel of the plungers 24 and 25 into the respective time-constant chambers 16 and 17, the outer ends of the elongated plungers at 38 are in transverse registration with the beginning portion of the green region 34 of the dial label 33. Air at atmospheric pressure is sealed within the indicating chamber 30 formed by the hollow region of the viewing cap 31 and the cylindrical bores 26 and 27 in the cylinder block 23.

A semipermeable membrane structure 41 is interposed in series with each of the fluid flow passageways 11–14 for providing a certain predetermined delay to the flow of fluid from the ambient pressure sensing chamber 10 to the respective time-constant chambers 16 and 17. The membrane structure 41 is contained within a rectangular recess 42 in the membrane plate 6. The membrane structure 41 includes a semipermeable membrane member 43 sandwiched between the bottom of the recess 42 and raised land portions of a membrane mat 44 which in turn abuts against the valve plate 8.

Figure 2:
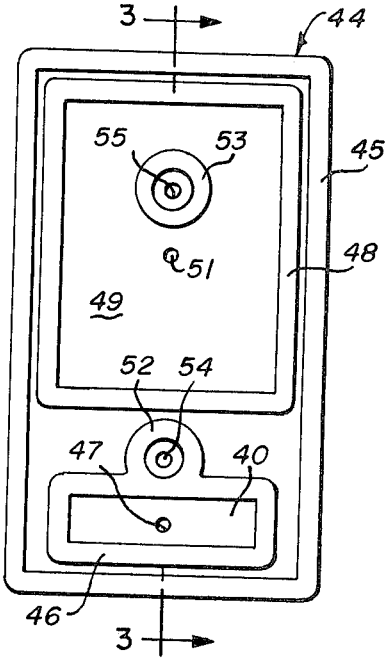
FIG. 2 is an enlarged plan view of a portion of the structure of FIG. 1 taken along lines 2—2 in the directions of the arrows.
Figure 3:
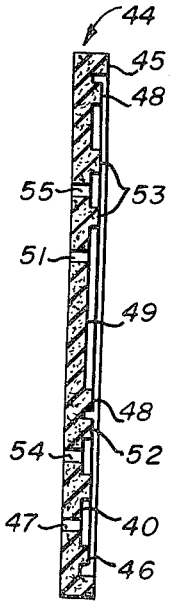
FIG. 3 is a sectional view of the structure of FIG. 2 taken along line 3—3 in the direction of the arrows.

Referring now to FIG. 2, the membrane mat 44 is shown in greater detail. The membrane mat 44 is generally rectangular having a generally rectangular sealing land 45 extending around the periphery of the mat 44. A second generally rectangular land 46 circumscribes a longitudinally directed bore 47 disposed in axial alignment with bore 13 in the membrane and valve plates 6 and 8, respectively. Likewise, a third generally rectangular land 48 circumscribes a larger recessed region 49 of the mat which is in gas communication with a second axial bore 51 passing through the mat 44 and disposed in axial alignment with bores 12 in the membrane and valve plates 6 and 8, respectively. A pair of relatively small diameter generally circular lands 52 and 53 are coaxially disposed of bores 54 and 55 in mat 44 which in turn are in axial alignment with bores 11 and 13, respectively.

The membrane 43 comprises, for example a 0.0003 inch thick layer of silicone rubber supported upon a porous cellulose acetate backing having a thickness of 0.004 inch. The effective area of the membrane which is connected in series with each of the respective bores 11–14 inversely determines together with spring constants of springs 28 and 29 the amount of delay for the flow of fluid from the ambient pressure sensing chamber to the respective time-constant chambers 16 and 17. More particularly, the upper time-constant chamber 16 and flow path 12 via membrane area 49 are dimensioned for analog computation of a tissue half time of 5 minutes, whereas the lower time-constant chamber 17 and flow path 14 via membrane area 40 are dimensioned for analog computation of tissue uptake for a tissue having a half time of 35 minutes. Therefore, less delay is desired in the flow path for the upper time constant chamber 16 and therefore the largest area 49 of the membrane is connected in series for flow of fluid through bore 12. Similarly, the relatively small rectangular recess portion 40, bounded by land 46, is in communication with bore 14 to approximate an analog computation of a tissue half time of 35 minutes. The annular areas bounded by circular lands 53 and 52 are much smaller and are dimensioned to approximate an analog computation of a membrane having a tissue half time of 250 minutes to form an analog computation of simulated outgassing of human tissue as employed for the basis of the Navy's repeat dive decompression tables.

A pair of check valve assemblies 61 and 62 are provided in series with the uptake gas passageways 12 and 14, respectively, communicating with the time-constant chambers 16 and 17, respectively. Each of the check valve assemblies 61 and 62 comprises a circular pliable valve diaphragm 63, as of neoprene rubber. The diaphragm includes an outer peripheral sealing ring portion 64 for being captured in sealing engagement between the valve block 9 and valve plate 8 to provide a hermetic seal to the respective time-constant chambers 16 and 17. In addition, the diaphragms 63 include centrally apertured raised land portions 65 disposed in axial alignment with axial bores 11 and 13, respectively in the membrane and valve plates 6 and 8. Each of the land portions 65 of the valve diaphragms 63 is spring biased against the opposed surface of the valve plate 8 via compression springs 66 and centrally apertured valve discs 67. The compression springs 66 are captured at one end by an inner lip of the respective time-constant chamber and at the other end by the outer peripheral portion of the valve disc 67.

In operation, the ambient pressure sensing chamber 10 is filled with a suitable working fluid such as air, although other working fluids may be employed, such as hydrocarbon liquids that would also be permeable to the particular membrane material selected. As the diver descends, the hydrostatic pressure builds up and this pressure is transmitted to the ambient pressure sensing chamber 10 by compressing the gas therein due to deformation of the bladder 4. The working fluid, such as air, then flows, primarily, through bores 12 and 14 and through the membrane areas 49 and 40 into the annular regions behind the check valve diaphragms 63. As an alternative to the use of an imperforate permeable membrane, porous material may be employed.

As soon as that pressure overcomes the light spring pressure of compression springs 66 and springs 28 and 29 the respective valve is unseated at 65 allowing the fluid to flow through the central aperture in the respective diaphragms 63 into the respective time-constant chamber 16 and 17. As the pressure builds up in the respective time-constant chamber the respective indicating piston is caused to be axially displaced and to move in the direction to cross the zones of the indicating dial 33.

It has been found that the Navy diving table data can be closely approximated by use of only two decompression analog computers, one being an analog computer of a half time tissue of 5 minutes and the other being an analog computer of a half time tissue of 35 minutes. The 35 minute computer yields satisfactory indications from 40 feet to approximately 100 feet, whereas the 5 minute half time tissue computer yields satisfactory indications from 100 to approximately 190 feet.

In the 5 minute one half time tissue computer, which is the upper computer in the drawings of FIG. 1, the pressure continues to build up in the time-constant chamber 16 producing a corresponding translation of the indicator rod 24 until such time as the pressure builds up to approximately 45 psi above one atmosphere. At this time the time-constant chamber 16 is expanded to its maximum extent and the indicator piston 24 has reached the red zone 36. Similarly, in the 35 minute half time tissue computer, which is the lower analog computer in the structure of FIG. 1, the pressure builds up in the time-constant chamber 17 until such time as the pressure therein reaches approximately 18 psi above one atmosphere at which time the end of the indicating piston rod 25 has reached the red zone 36.

The tissue ratio springs 28 and 29 are chosen to have spring constants for approximating tissue ratios of 3.96 for the 5 minute tissue computer and 2.25 for the 35 minute tissue computer. These springs 28 and 29 oppose displacement of the pistons 24 and 25, respectively, which are coupled to the time-constant chamber so that the movement of the indicator piston is less than it would otherwise be and allowance is made for the ability of the human body tissue to withstand an internal overpressure without nucleating gas bubbles.

As the diver ascends to the surface an ambient pressure will be sensed in the chamber 10 which is less than the pressure within either of the respective time-constant chambers 16 and 17. When this condition occurs, the check valves 61 and 62 will close off bores 12 and 14 such that the return flow of fluid from the respective time-constant chambers must flow to the ambient pressure chamber through the centrally disposed bores 11 and 13, respectively. This return flow, which simulates tissue outgassing, must diffuse through the relatively small area of the membrane bounded by lands 53 and 52, respectively. Thus, the time constant for the computer when simulating the outgassing of the half time tissues is chosen to have a relatively long half time, as of 250 minutes, to approximate the relatively long half time tissue assumption utilized in calculating the standard Navy decompression tables for repetitive dives.

Thus, as the gas in the time-constant chambers, under the influence of its own pressure and under the influence of the return springs 28 and 29, flows from the respective time-constant chambers 16 and 17 back to the ambient pressure sensing chamber the respective indicating plungers pistons 24 and 24 are retracted. In this manner, outgassing of the human tissues is simulated such that repetitive dives can be made and the computer 1 will automatically simulate the outgassing of human tissues upon the same basis as employed for the Navy repeat decompression tables.

Thus, the diver may make as many repeat dives as desired and can avoid decompression by merely monitoring the indicating pistons and avoiding operation in the red zone.

In a typical example, the decompression computer 1 has an overall length of approximately 3.75 inches, a width of 2.25 inches and a thickness of 1.125 inches. The longitudinal bores 11–14 have diameters of 0.031 inches and the ambient pressure sensing bladder 4 has an axial depth of approximately 1.0 inch, a width of approximately 1.6 inches and a thickness of approximately 0.75 inch. The indicating pistons 24 and 25 have a maximum axial translation of approximately 0.5 inches.

The advantage of the decompression computer of the present invention is that it automatically computes for repeat dive decompression due to the outgassing tissue half time simulation of 250 minutes, such outgassing tissue half time being substantially longer than the simulated uptake tissue half times. Thus, repeat dive decompression warning is automatically computed by the decompression computer without having to make reference to the standard Navy decompression repetitive dive tables.

In addition, the indicating pistons are coupled directly to a movable wall of the time constant chamber without the requirement of any mechanical multiplication. Thus a reliable, rugged and simple indicating means is provided for indicating the output of the respective decompression analog computers.

As an alternative to the pistons 24 and 25 moving across an indicator dial 33, the indicator zones may be printed or painted in rings on the respective pistons so that as the piston moves outwardly of the time constant chamber and cylinder bore 26 or 27 it uncovers successive green, yellow, and then red zone rings.

What is claimed is:

1. In a decompression indicating instrument for divers:

ambient pressure sensing chamber means containing a working fluid therein, said working fluid being subjected to hydrostatic pressure when the instrument is submerged in water;

time-constant chamber means;

fluid communication means disposed intermediate said sensing and time-constant chamber means for providing fluid communication therebetween;

delay means operatively associated with said fluid communication means for delaying the flow of fluid from said sensing chamber to said time-constant chamber with a first half time delay characteristic to simulate uptake of gas by human tissue of a first tissue half time, and for delaying the flow of fluid from said time-constant chamber to said ambient sensing chamber with a second half time delay characteristic longer than said first tissue half time delay characteristic to approximate outgassing of human tissue under the ambient hydrostatic pressure of the instrument, said delay means including a check valve means in said fluid communication means, said check valve means being connected for passing fluid from said ambient sensing chamber to said time-constant chamber with a first resistance to flow of fluid therebetween while providing a second resistance to fluid flow from said time-constant chamber to said ambient sensing chamber, said second resistance to fluid flow being greater than said first resistance to fluid flow, and indicating means operatively associated with and responsive to the fluid pressure in said time-constant chamber for indicating to the diver whether decompression is necessary.

2. The apparatus of claim 1 wherein said check valve means includes a valve member movable between a seated and an unseated position for variably restricting the flow of fluid through said fluid communication means, and means for spring biasing said movable valve member towards the seated position against the flow of fluid from said ambient sensing chamber means to said time-constant chamber means, such that when the pressure in said ambient sensing chamber means is sufficiently higher than the fluid pressure in said time-constant chamber means, said valve member is pushed open by said pressure differential against said spring biased force to provide flow of fluid to said time-constant chamber means, whereas when the pressure in said time-constant chamber means is higher than that of said ambient sensing chamber means said valve member is biased to the seated or high resistance position.

3. The apparatus of claim 1 wherein said time-constant chamber means includes a movable wall portion and wherein said indicating means includes, piston means operatively coupled to said movable wall of said time-constant chamber means such that said piston is caused to move to and fro in response to pressure changes in said time-constant chamber means, and decompression indicia scale means operatively associated with said movable piston so that the position of said movable piston serves as a decompression indicator for the diver.

4. The apparatus of claim 3 including, means for spring biasing said piston inwardly of said time-constant chamber with a certain predetermined spring constant, said spring constant being chosen to approximate a certain physiological internal overpressure of human tissue which can be tolerated without nucleation of gas entrapped in the tissue.

5. The apparatus of claim 4 wherein said spring constant corresponds to a tissue ratio falling within the range of 2.0 to 2.5.

6. The apparatus of claim 4 wherein said spring constant corresponds to a tissue ratio falling within the range of 3.5 to 4.5.

7. The apparatus of claim 4 wherein said spring constant is chosen such that when the pressure in said time-constant chamber builds up to a pressure in excess of 50 psi said indicator indicates decompression is necessary.

8. The apparatus of claim 4 wherein said spring constant is such that when the pressure in said time-constant chamber builds up to a pressure in excess of 20 psi said indicator means indicates decompression is necessary.

9. The apparatus of claim 1 wherein said second tissue half time is in the range of 15 to 100 times larger than said first tissue half time.

10. The apparatus of claim 1 wherein said second tissue half time is in the range of 40 to 60 times larger than said first tissue half time.

11. In a decompression indicating instrument for divers:

ambient pressure sensing chamber means subjected to hydrostatic pressure when the instrument is submerged in water and containing a working fluid therein;

time-constant chamber means having a movable wall portion;

fluid communication means disposed intermediate said ambient pressure sensing and time-constant chamber means for providing fluid communication therebetween;

delay means for delaying the flow of fluid via said fluid communication means between said ambient pressure sensing and second time-constant chamber means to approximate the gas content of human tissue under the ambient hydrostatic pressure experienced by the instrument, said delay means including an imperforate fluid diffusion membrane means interposed in said fluid communication means for impeding the fluid flow therethrough;

indicator means responsive to the fluid pressure in said time-constant chamber means for indicating to the diver whether decompression is necessary; and wherein said indicating means includes, piston means operatively coupled to said movable wall portion of said time-constant chamber means such that said piston is caused to move to and fro along a rectilinear path in response to pressure changes in said time-constant chamber means, and decompression indicia scale means operatively associated with said movable piston for indicating the requirement of decompression for the diver.

12. The apparatus of claim 11 including, means for spring biasing said piston inwardly of said time-constant chamber means with a certain predetermined spring constant, said spring constant being chosen to approximate a certain internal overpressure of human tissue.

13. The apparatus of claim 12 wherein said spring constant corresponds to a tissue ratio falling within the range of 2.0 to 2.5.

14. The apparatus of claim 12 wherein said spring constant corresponds to a tissue ratio falling within the range of 3.5 to 4.5.

15. The apparatus of claim 12 wherein said spring constant is chosen such that when the pressure in said time-constant chamber means builds up to a pressure in excess of 50 psi said indicator means indicates decompression is necessary.

16. The apparatus of claim 12 wherein said spring constant is chosen such that when the pressure in said time-constant chamber means builds up to a pressure in excess of 20 psi said indicator means indicates decompression is necessary.

17. A self contained decompression instrument for use by a diver comprising:

a submersible housing having an optically transparent portion and a water permeable portion;

an ambient pressure fluid chamber disposed in said housing adjacent said water permeable portion such that ambient water pressure is transmitted to said ambient pressure sensing chamber for causing the pressure therein to track with the ambient water pressure;

pressure responsive means disposed in said housing and movable relative to said housing in response to fluctuations of pressure sensed by said pressure responsive means;

delay means in said housing operatively associated with said ambient pressure sensing chamber means and said pressure responsive means and including an imperforate fluid diffusion membrane means to delay transmission of said ambient pressure in said ambient pressure sensing chamber to said pressure responsive means in accordance with a first tissue half time simulating the uptake of gas by a diver's tissue during an underwater excursion and for delaying the transmission of pressure from said pressure responsive means to said ambient pressure sensing chamber with a second tissue half time substantially longer than said first tissue half time to simulate the release of gas by a diver's tissues during an underwater excursion; and indicator means in said housing having indicia visible through said optically transparent portion of said housing and operatively associated with said pressure responsive means for indicating to the diver when decompression is necessary.

* * * * *